US005281896A

United States Patent [19]

Bae et al.

[11] Patent Number: 5,281,896

[45] Date of Patent: Jan. 25, 1994

[54] ELECTRON GUN FOR CRT

[75] Inventors: Min-Cheol Bae, Seoul; Sang-Jin Park, Kyungsangnam, both of Rep. of Korea

[73] Assignee: Samsung Electron Devices Co., Ltd., Kyunggi, Rep. of Korea

[21] Appl. No.: 937,171

[22] Filed: Aug. 31, 1992

[30] Foreign Application Priority Data

Sep. 27, 1991 [KR] Rep. of Korea ..... 91-15870

[51] Int. Cl.[5] ..... H01J 29/46; H01J 29/56

[52] U.S. Cl. ..... 315/15; 315/382; 313/414

[58] Field of Search ..... 315/15, 382, 382.1; 313/414, 449

[56] References Cited

U.S. PATENT DOCUMENTS 4,701,677 10/1987 Ashizaki et al. ..... 315/15

5,055,749 10/1991 Chen et al. ..... 315/382

*Primary Examiner*—Theodore M. Blum

*Attorney, Agent, or Firm*—Leydig, Voit & Mayer

[57] ABSTRACT

An electron gun for a color cathode ray tube includes cathodes, a control electrode and a screen electrode which form a front triode, first, second, third, fourth and fifth focus electrodes which form a plurality of auxiliary electrostatic lenses, and a final accelerating electrode installed adjacent to the fifth focus electrode to form a main electrostatic lens, wherein vertically-elongated electron beam passing holes are formed on the fourth focus electrode, a predetermined focus voltage is applied to the first, second and fifth focus electrodes, a dynamic focus voltage lower than the focus voltage and synchronized with a deflection synchronizing signal is applied to the fourth focus electrode, a static voltage higher than the focus voltage is applied to the second focus electrode, and an anode voltage higher than the focus voltage is applied to the final accelerating electrode.

10 Claims, 5 Drawing Sheets

ELECTRON GUN FOR CRT

BACKGROUND OF THE INVENTION

The present invention relates to an electron gun for a CRT, and more particularly to an electron gun for a CRT having an improved method for applying voltage to respective electrodes constituting the electron gun.

Usually, a CRT, such as that shown in FIG. 1, comprises a panel P on the inner side of which a shadow mask assembly SF is mounted, and a funnel adhered to the panel in which an electron gun G is installed in the neck N of the funnel and a deflection yoke D is installed on the outer side of the neck.

In such a CRT, even if all three electron beams emitted from the electron gun are optimally focused on the center of a phosphor layer formed on the inner side of panel P, the electron beams deflected toward the periphery of the phosphor layer by deflection yoke D differ among one another in their focal distances, when landed on the phosphor layer. This is due to the geometric curvature of the inner surface of panel P and the fact that the electron gun is disposed in an in-line form. Also, when the electron beams are deflected toward the periphery of the phosphor layer, the cross sections of the electron beams are distorted due to the non-uniform magnetic field of the deflection yoke, so that the cross sections of the electron beams cannot be formed regularly throughout the phosphor layer. This causes the reduction of the CRT's resolution.

FIG. 2 illustrates a conventional electron gun for a CRT which solves the above problem. Referring to FIG. 2, the electron gun comprises cathodes 2, a control electrode 3, a screen electrode 4 which form a front triode, a focus electrode 5, a dynamic focus electrode 6 and an anode electrode 7 which concentrate and accelerate electron beams. Vertically-elongated electron beam passing holes 5H and horizontally-elongated electron beam passing holes 6H are formed on projection side 5*a* of focus electrode 5 and incidence side 6*a* of dynamic focus electrode 6, respectively. Focus voltage Vf and anode voltage Ve are applied to focus electrode 5 and anode electrode 7, respectively. Dynamic focus voltage Vd, which, taking focus voltage Vf as a base voltage, is varied according to the vertical and horizontal synchronous signals of the deflection yoke, is applied to dynamic focus electrode 6.

In the above electron gun for a CRT, when electron beams emitted from cathodes 2 are deflected toward the periphery of the phosphor layer, dynamic focus voltage Vd is applied to dynamic focus electrode 6 to form a quadruple lens between focus electrode 5 and dynamic focus electrode. Specifically, due to vertically-elongated electron beam passing holes 5H formed on projection side 5*a* of focus electrode 5 and horizontally-elongated electron beam passing holes 6H formed on incidence side 6*a* of dynamic focus electrode 6, a relatively weak condenser lens and a relatively intense divergent lens as compared with those in the horizontal direction, are formed vertically. Meanwhile, a relatively intense condenser lens and a relatively weak divergent lens as compared with those in the vertical direction, are formed horizontally. The electron beams passing through the lenses converge horizontally and diverge vertically so that their cross sections become vertically elongated. Thus, the distortion of the electron beams can be compensated for by a non-uniform magnetic field formed when the electron beams are deflected toward the periphery of the phosphor layer by the deflection yoke, so that a circular spot of the electron beams can be obtained on the periphery of the phosphor layer.

Further, since focus voltage Vf and dynamic focus voltage Vd are mixedly applied to dynamic focus electrode 6, the potential difference between the focus electrode and anode electrode 7 becomes small to reduce the intensity of a main lens formed therebetween and to elongate the electron beams' focal length, so that the electron beams are focused on the periphery of the phosphor layer in a favorable form.

The conventional electron gun, as described above, can compensate for the electron beams' focus characteristic and astigmatism. However, the conventional electron gun has a poor withstand voltage because a high voltage is applied to dynamic focus electrode 6. Withstand voltage is defined as the maximum voltage which can be safely supplied to electrodes without causing the destruction of insulation in connection with the electrodes. The circuit for applying the high dynamic focus voltage is difficult to construct. Furthermore, since the variation of the focal length of the electron beams emitted from the cathodes and the shaping of the electron beams' cross sections are carried out near the high voltage portion adjacent to a final accelerating electrode for finally accelerating the electron beams, when the dynamic focus voltage is applied, convergence drift, in which convergence for focusing three electron beams is varied, occurs to reduce a convergence characteristic. Convergence drift is herein defined as the deviation of the focusing of the electron beams on the electron beam passing hole.

To overcome these problems, a low voltage driving method is adapted, in which a voltage for controlling the focusing distance of electron beams from the electron gun to the phosphor layer is lower than a fixed focus voltage. However, this method is disadvantageous since it greatly reduces the compensating effect of the focus characteristic.

SUMMARY OF THE INVENTION

Therefore, it is an object of the present invention to provide an electron gun for a color CRT having an improved wiring method for applying a voltage to respective electrodes and their electron beam passing holes, so as to compensate for the distortion of the electron beams' cross section due to a focus characteristic and a deflection yoke, and enhance the resolution of a color CRT employing the electron gun.

To accomplish the object, there is provided an electron gun for a color cathode ray tube comprising cathodes, a control electrode and a screen electrode which form a front triode, first, second, third, fourth and fifth focus electrodes which form a plurality of auxiliary electrostatic lenses, and a final accelerating electrode installed adjacent to the fifth focus electrode to form a main electrostatic lens, wherein vertically-elongated electron beam passing holes are formed on the fourth focus electrode, a predetermined focus voltage is applied to the first, second and fifth focus electrodes, a dynamic focus voltage lower than the focus voltage and synchronized with a deflection synchronizing signal is applied to the fourth focus electrode, a static voltage higher than the focus voltage is applied to the second focus electrode, and an anode voltage higher than the focus voltage is applied to the final accelerating electrode.

In the election gun of the present invention, the voltage applied to the second focus electrode equals that applied to the anode voltage.

BRIEF DESCRIPTION OF THE DRAWINGS

The above object and other advantages of the present invention will become more apparent by describing in detail a preferred embodiment of the present invention with reference to the attached drawings in which.

DETAILED DESCRIPTION OF THE INVENTION

Figure 1:
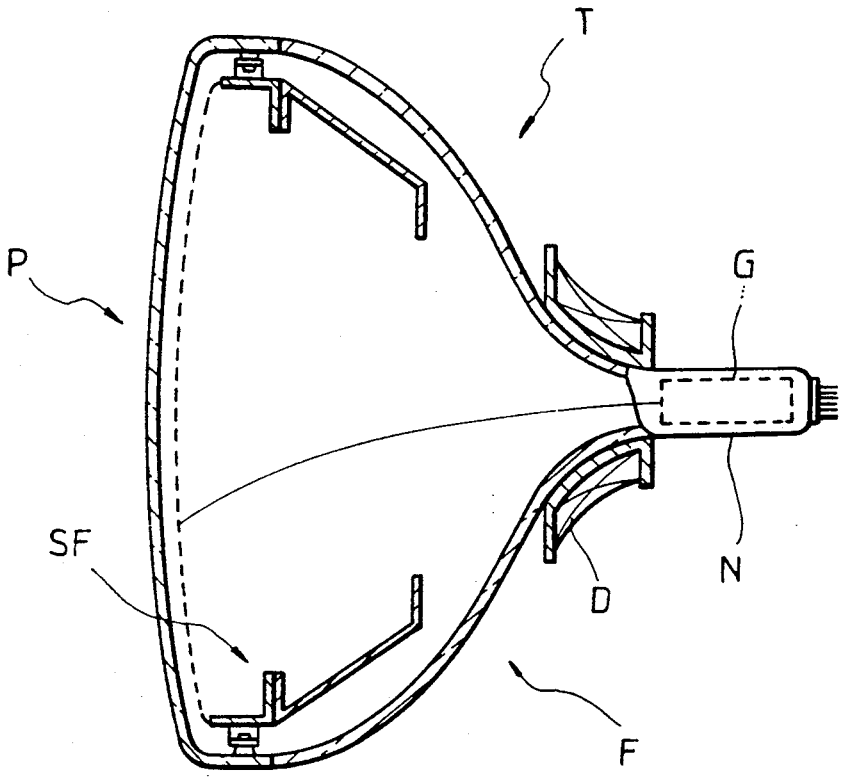
FIG. 1 is a cross-sectional view of a typical color CRT.
Figure 2:
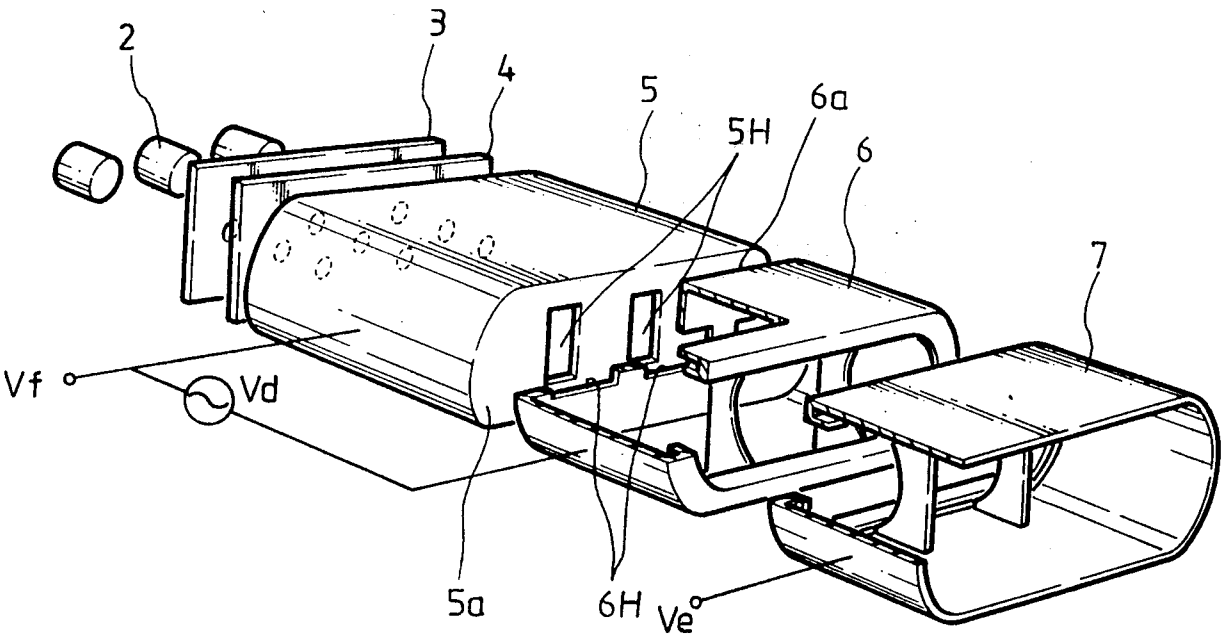
FIG.2 (PRIOR ART)
FIG. 2 is a perspective view of a conventional electron gun for a color CRT.
Figure 3:
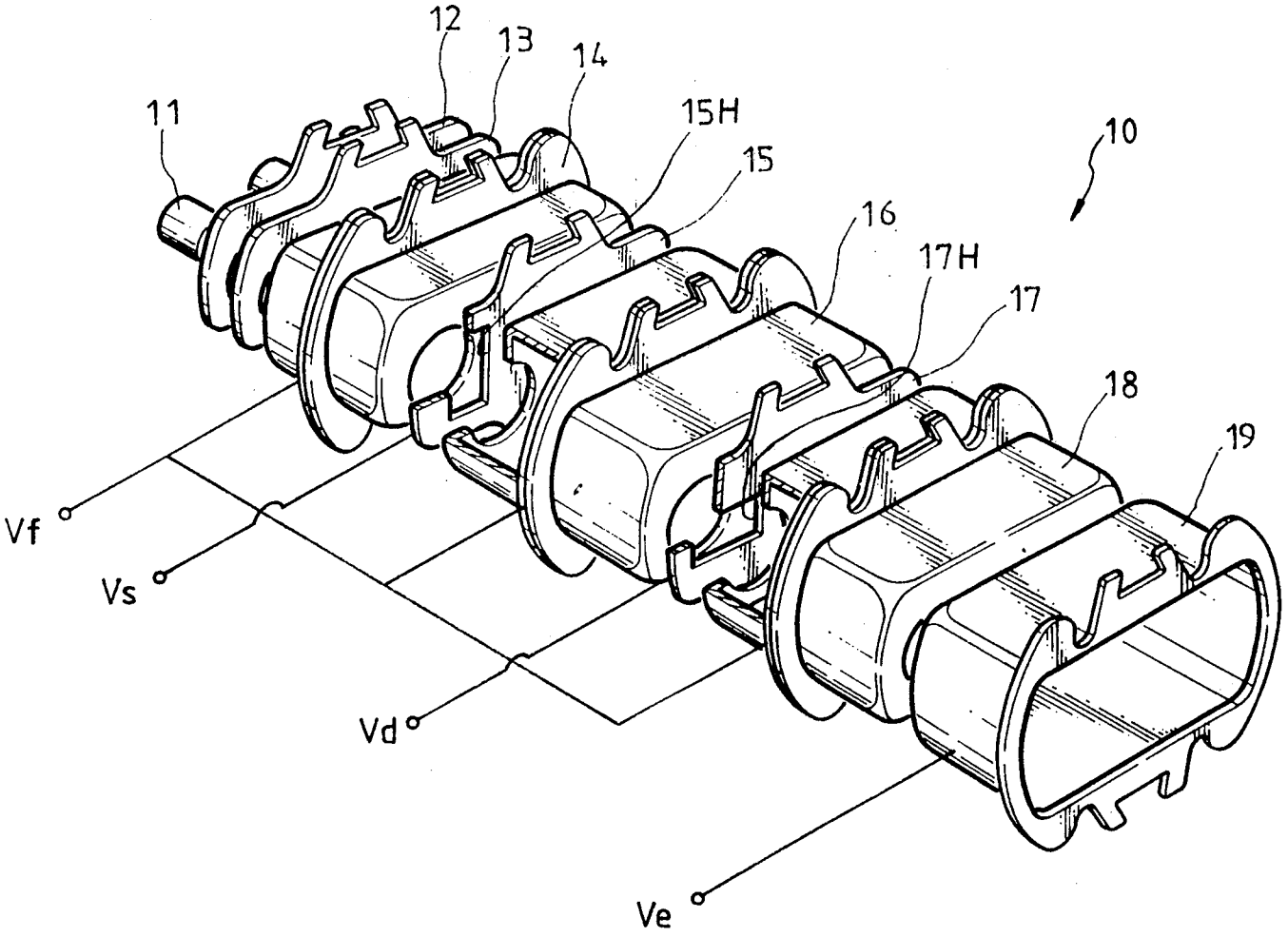
FIG. 3 is a perspective view of an electron gun for a color CRT according to the present invention, particularly showing a voltage applying method.
Figure 4A:
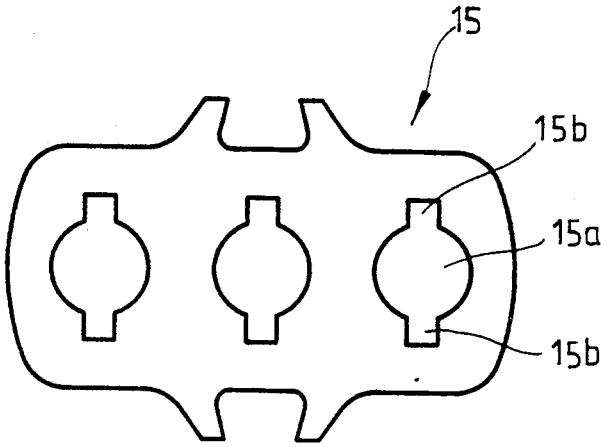
FIG. 4A is a front view of another embodiment of a second focus electrode shown in FIG. 3.
Figure 4B:
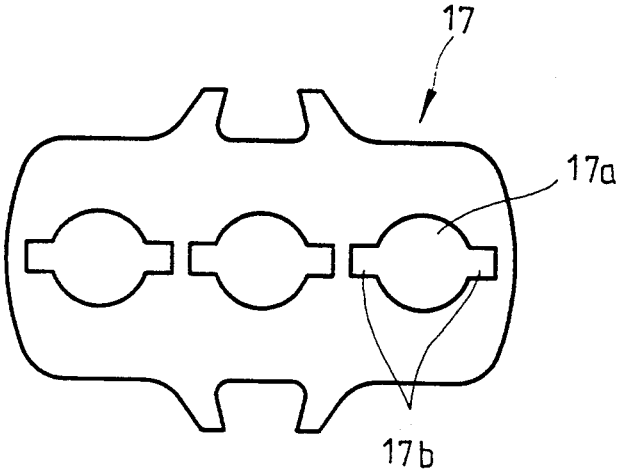
FIG. 4B is a front view of another embodiment of a fourth focus electrode shown in FIG. 3.
Figure 4C:
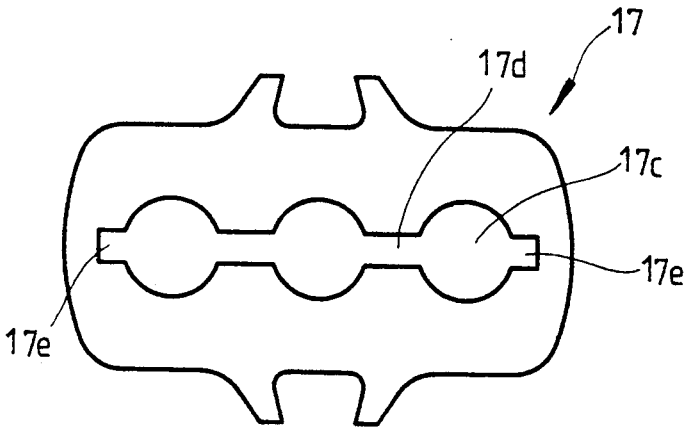
FIG. 4C is a front view of yet another embodiment of a fourth focus electrode shown in FIG. 3.

Referring to FIG. 3, an electron gun for CRT of the present invention comprises cathodes 11, a control electrode 12, a screen electrode 13 which form a front triode, first, second, third, fourth and fifth focus electrodes 14, 15, 16, 17 and 18 which form an auxiliary lens section and are disposed sequentially from screen electrode 13, and a final accelerating electrode 19 forming a main lens section. Vertically-elongated electron beam passing holes 15H are formed on second focus electrode 15 and horizontally-elongated electron beam passing holes 17H are formed on fourth focus electrode 17. Here, the form of the electron beam passing holes provided on the electrodes of electron gun 10 can be modified as long as the basic arrangement of the electrostatic lenses does not change. For instance, as shown in FIG. 4A, the vertically-elongated electron beam passing holes may be formed on second focus electrode 15 by having vertically opposite recesses **15*b* extended from circular passing holes 15*a*. As shown in FIG. 4B, the horizontally-elongated electron beam passing holes may be formed on fourth focus electrode 17 by having horizontally opposite recesses 17*b* extended from circular passing holes 17*a*. As shown in FIG. 4C, the horizontally-elongated electron beam passing holes may be formed by forming a slot 17*d*, which horizontally connects three in-line circular passing holes 17*c*, and having recesses 17*e* opposite to slot 17*d*** outwardly extended from the two outer circular passing holes.

A predetermined voltage is applied to the respective electrodes constituting electron gun 10. First, a predetermined focus voltage Vf is applied to first, third and fifth focus electrodes 16, 17 and 18. A static voltage Vs higher than focus voltage Vf is applied to second focus electrode 15. A dynamic focus voltage Vd, which is lower than focus voltage Vf and synchronized with the deflection signal of the deflection yoke, is applied to fourth focus electrode 17. An anode voltage Ve higher than focus voltage Vf is applied to final accelerating electrode 19. Here, it is desirable that static voltage Vs applied to second focus electrode 15 be the same potential as anode voltage Ve or, at least be of a greater potential than focus voltage $V_f$. Anode voltage $V_e$ is preferably in the range of 25 kV–35 kV and focus voltage $V_f$ is preferably about 20%–35% of anode voltage $V_e$. Dynamic focus voltage $V_d$ preferably ranges from 400 V to 4000 V.

Now, operation of the electron gun for a CRT of the present invention will be described below.

Figure 5:
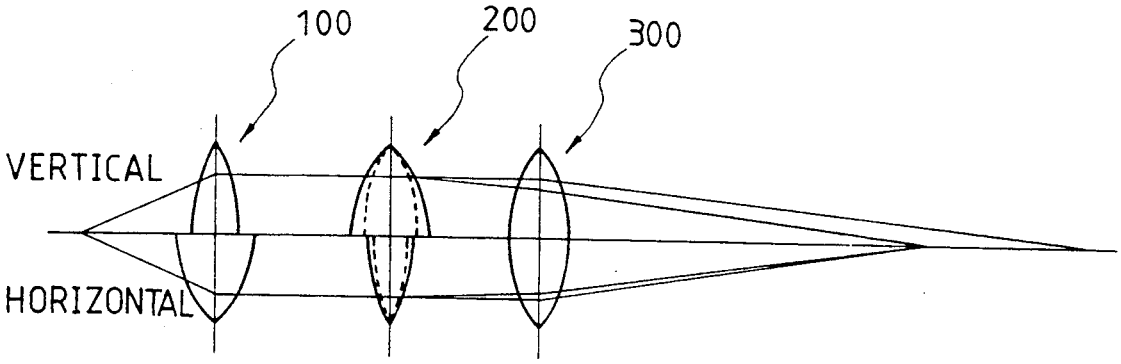
FIG. 5 visualizes electrostatic lenses formed between the electrodes of the electron gun for a color CRT of the present invention.

First, as voltages are applied to its electrodes, electron gun 10 for a CRT according to the present invention, as shown in FIG. 5, a first auxiliary electrostatic lens 100, which is a bipotential focus electrostatic lens, is formed between first and second focus electrodes 14 and 15. A second auxiliary lens 200, which is a unipotential focus electrostatic lens, is formed among third, fourth and fifth focus electrodes 16, 18, and 19. A main electrostatic lens 300 is formed between fifth focus electrode 18 and final accelerating electrode 19. The electron beams emitted from cathode 11 pass through each of the electrostatic lenses and land on the phosphor layer formed on the inner side of the panel. The landing state of the electron beams can be explained with respect to the center and periphery of the phosphor layer.

First, when the electron beams emitted from cathodes 11 are projected toward the center of the phosphor layer, the dynamic focus voltage synchronized with the deflection signal of the deflection yoke is not applied to fourth focus electrode 17, and static voltage Vs being the same potential as that applied to final accelerating electrode 19 is applied to second focus electrode 15. Thus, as shown in FIG. 5, the magnification of first auxiliary electrostatic lens 100 formed between first and second focus electrodes 14 and 15 is relatively small vertically and relatively large horizontally, due to vertically-elongated electron beam passing holes 15H. Meanwhile, the magnification of second auxiliary electrostatic lens 200 formed among third, fourth and fifth focus electrodes 16, 17 and 18 is relatively large vertically and relatively small horizontally, due to horizontally-elongated electron beam passing holes 17H.

Accordingly, the electron beams emitted from cathodes 11 converge more intensely horizontally than vertically, passing through first auxiliary electrostatic lens 100, and converge more intensely vertically than horizontally, passing through second auxiliary electrostatic lens 200. The electron beams passing through first and second electrostatic lenses 100 and 200 exhibit an equilibrium of convergence. The electron beams pass through main electrostatic lens 300 to be finally converged and accelerated. The cross sections of the electron beams landing on the center of the phosphor layer become circular.

When the electron beams emitted from cathodes 11 are deflected toward the periphery of the phosphor layer, since dynamic focus voltage Vd synchronized with the deflection synchronizing signal is applied to fourth focus electrode 17, the potential difference between third and fifth focus electrodes 16 and 18 and fourth focus electrode 17 becomes relatively small. Thus, the magnification of second auxiliary electrostatic lens 200 formed therebetween also becomes relatively small, as compared with when the electron beams are projected toward the center. However, since electron beam passing holes 17H formed on fourth focus electrode 17 are horizontally elongated, the horizontal and vertical magnifications of second auxiliary electrostatic lens 200 become different. In other words, since fourth focus electrode 17 has horizontally-elongated electron beam passing holes 17H, the distribution density of electric field therebetween is higher vertically than horizontally so that its vertical magnification is relatively large as compared with the horizontal magnification.

As a result, the electron beams emitted from cathodes 11, as shown in FIG. 5, converge weakly vertically but intensely horizontally, while passing through first auxiliary electrostatic lens 100. Since, passing through second auxiliary electrostatic lens 200 which is relatively weakened by applied dynamic focus voltage Vd, the electron beams which were previously weakly converged in the vertical direction and intensely in the horizontal direction by first auxiliary electrostatic lens 100, converge relatively weakly vertically as compared with those projected toward the phosphor's center and pass through main electrostatic lens 300. Also, their focal length is elongated vertically. Since the electron beams emitted from cathodes 11 intensely converge horizontally while passing through the first electrostatic lens and pass through a relatively weakened electrostatic lens 200 and main electrostatic lens 300, their focal length is shortened more horizontally than vertically.

Accordingly, the cross sections of the electron beams emitted from the electron gun are vertically elongated due to the difference between their horizontal and vertical focal lengths. The distortion of the electron beams' vertically-elongated cross sections is corrected by the non-uniform magnetic field of the deflection yoke, so that nearly circular beam spots can be obtained on the periphery of the phosphor layer.

As described above, the electron gun for a CRT can attain a uniform cross section of the electron beams, throughout the phosphor layer, by varying the intensity of the auxiliary electrostatic lens in synchronization with a deflection synchronizing signal so as to control a focal length, thereby enhancing the resolution of a CRT employing the electron gun. Further, the electron gun can enhance a CRT's withstand voltage characteristic by controlling the focal length while using a dynamic focus voltage lower than the focus voltage.

While the invention has been particularly shown and described with reference to preferred embodiments thereof, it will be understood by those skilled in the art that various changes in form and details may be made therein without departing from the spirit and scope of the invention as defined by the appended claims.

What is claimed is:

1. An electron gun for a color cathode ray tube comprising:

a triode including a plurality of cathodes, a control electrode and a screen electrode;

a first focus electrode;

a second focus electrode having a plurality of vertically elongated electron beam passing holes;

a third focus electrode;

a fourth focus electrode having at least one horizontally elongated electron beam passing holes;

a fifth focus electrode;

an accelerating electrode adjacent to said fifth focus electrode;

first voltage supplying means connected to said first, third and fifth electrodes for supplying a predetermined focus voltage to said first, third and fifth electrodes;

second voltage supplying means connected to said second electrode for supplying a predetermined static focus voltage to said second electrode;

third voltage supplying means connected to said fourth electrode for supplying a predetermined dynamic focus voltage to said fourth electrode; and a fourth voltage supplying means connected to said accelerating electrode for supplying a predetermined anode voltage to said accelerating electrode.

2. An electron gun for a color cathode ray tube as claimed in claim 1 wherein the static voltage is equal to the anode voltage.

3. An electron gun for a color cathode ray tube as claimed in claim 1 wherein the static focus voltage is greater than the focus voltage.

4. An electron gun for a color cathode ray tube as claimed in claim 1 wherein the dynamic focus voltage is less than the focus voltage.

5. An electron gun for a color cathode ray tube as claimed in claim 1 wherein the dynamic focus voltage ranges from 400 V to 4000 V.

6. An electron gun for a color cathode ray tube as claimed in claim 1 wherein the anode voltage ranges from 25 kV to 35 kV.

7. An electron gun for a color cathode ray tube as claimed in claim 1 wherein the focus voltage is between 20% to 35% of the anode voltage.

8. An electron gun for a color cathode ray tube as claimed in claim 1, wherein the vertically elongated electron beam passing holes comprise vertically opposite recesses extending from circular passing holes.

9. An electron gun for a color cathode ray tube as claimed in claim 1, wherein each horizontally elongated electron beam passing holes comprises horizontally opposite recesses extending from a circular passing hole.

10. An electron gun for a color cathode ray tube as claimed in claim 1, wherein the horizontally elongated electron beam passing hole comprises a plurality of horizontally aligned circular passing holes, each hole being connected by a slot.

* * * * *